US007198547B2

(12) United States Patent
Kim et al.

(10) Patent No.: US 7,198,547 B2
(45) Date of Patent: Apr. 3, 2007

(54) LENS EDGER

(75) Inventors: Young Hun Kim, Uiwang-si (KR); Soon Yong Shim, Seoul (KR)

(73) Assignee: Huvitz Co., Ltd. (KR)

( * ) Notice: Subject to any disclaimer, the term of this patent is extended or adjusted under 35 U.S.C. 154(b) by 0 days.

(21) Appl. No.: 11/413,040

(22) Filed: Apr. 26, 2006

(65) Prior Publication Data

US 2006/0281392 A1 Dec. 14, 2006

(30) Foreign Application Priority Data

Jun. 13, 2005 (KR) ..... 10-2005-0050193

(51) Int. Cl.

| | |
|---|---|
| ***B24B 49/00*** | (2006.01) |
| ***B24B 1/00*** | (2006.01) |
| ***B24B 7/19*** | (2006.01) |
| ***B24B 7/30*** | (2006.01) |

(52) U.S. Cl. ..... 451/8; 451/28; 451/42; 451/43; 451/44; 451/365; 451/384; 451/240; 451/255; 451/256; 451/277

(58) Field of Classification Search ..... 451/8, 451/28, 42, 43, 44, 240, 255, 256, 277, 365, 451/384

See application file for complete search history.

(56) References Cited

U.S. PATENT DOCUMENTS 4,596,091 A * 6/1986 Daboudet et al. ..... 451/240
4,737,053 A * 4/1988 Paolini ..... 409/104
6,618,952 B2 * 9/2003 Andrews et al. ..... 33/507

* cited by examiner

*Primary Examiner*—Joseph J. Hail, III
*Assistant Examiner*—Shantese McDonald
(74) *Attorney, Agent, or Firm*—Blakely Sokoloff Taylor & Zafman

(57) ABSTRACT

A lens edger which is capable of measuring the curvature of an eyeglass lens is disclosed. The lens edger includes a carriage which rotatably fixes a pair of lens fixing shafts and moves the position of the lens fixing shafts clamping a lens to be processed; a lens rotation motor for rotating the lens fixing shafts; a carriage driving means for moving the carriage; and an apparatus for measuring a curvature of the lens. The apparatus for measuring lens curvature includes a curvature tracer which contacts with a side of the lens and detects a curvature of the lens by moving horizontally according to the curvature of the lens during a rotation of the lens; a curvature tracer rotator which rotates the curvature tracer to a position for measuring the lens curvature, and to which one end of the curvature tracer is inserted in a manner of allowing sliding movement of the curvature tracer in a horizontal direction; and a slider base which guides the movement of the curvature tracer in the horizontal direction, and provides a restoring force to the curvature tracer so that the lens and the curvature tracer can be maintained in a contacted state.

7 Claims, 3 Drawing Sheets

LENS EDGER

FIELD OF THE INVENTION

This invention relates to a lens edger having apparatus for measuring lens curvature, and more specifically to a lens edger which is capable of measuring the curvature of an eyeglass lens for forming a bevel or a groove at the edge of the eyeglass lens.

BACKGROUNDS OF THE INVENTION

In general, a patternless lens edger measures the shape of an eyeglass frame or the shape of an eyeglass lens to be processed with a tracer, makes data corresponding to the measured shape, and grinds a blank lens according to the produced data by servo-controlling the positions of the axes fixing the blank lens to produce a lens having a desired shape. The patternless lens edger not only processes the overall shape of an eyeglass lens, but also forms a groove at the edge side of the lens for fixing a lens-fixing wire (grooving operation), chamfers the edge side of the lens (chamfering operation), and forms a bevel of a triangle shape at the edge side of the lens for securely fixing the lens to the groove line formed inside of an eyeglass frame (bevel forming operation). FIG. 1 is a perspective view for illustrating a conventional patternless lens edger, and FIG. 2 is a perspective view of the internal structures of a conventional patternless lens edger for illustrating the operation of the lens edger. As shown in FIG. 1, on the upper part of the patternless lens edger are formed an opening windows 2 for mounting an eyeglass lens inside of the lens edger and several control-switches 3 for controlling the lens edger. As shown in FIG. 2, the patternless lens edger includes a pair of lens fixing shafts 10 for clamping a blank eyeglass lens (not shown) to be processed; a carriage 12 which rotatably fixes the lens fixing shafts 10 and moves the position of the lens fixing shafts 10; a lens rotation motor 13 for rotating the lens fixing shafts 10; a carriage movement axis 14 which is attached at one end of the carriage 12 for allowing a rotational movement of the carriage 12 around the axis 14 and a sliding movement of the carriage 12 in the longitudinal direction of the axis 14; a horizontal driving means 16 which is attached to the one side of the carriage 12 for slidably moving the carriage 12 in the longitudinal direction of the carriage movement axis 14; and a vertical driving means 18 which is attached to the other side of the carriage 12 for rotating the carriage 12 in the rotational direction of the carriage movement axis 14. Also, the patternless lens edger further includes a diamond grinding wheel 20 for grinding the eyeglass lens clamped by the lens fixing shafts 10 to a desired shape, and a groove forming member 30 for forming a groove at the edge side the lens.

In operation, a lens is clamped between a pair of lens fixing shafts 10, and the part of the lens to be grinded is directed to the diamond grinding wheel 20 by driving the lens rotation motor 13. The horizontal driving means 16 and the vertical driving means 18 moves the carriage 12 in the horizontal and vertical directions, so that the lens clamped by the lens fixing shafts 10 contacts with the diamond grinding wheel 20. Then the lens is grinded by rotating the diamond grinding wheel 20 in a high speed. After processing the overall shape of the lens with the grinding wheel 20, the carriage 12 moves so that the processed lens contacts with the groove forming member 30 for a grooving operation, a chamfering operation, or a bevel forming operation at the edge side of the lens. For an accurate and precise grooving operation, chamfering operation, or bevel forming operation, the curvature of the processed lens should be precisely measured with an apparatus for measuring lens curvature, and the movement of the carriage 12 should be precisely controlled according to the measured curvature during the grooving operation, chamfering operation, or bevel forming operation. If the curvature of the lens is not considered for these operations, the processed lens may not be accurately fitted into the eyeglass frame, and the lens having a groove, a bevel or a chamfered part may be undesirable in its shape.

SUMMARY OF THE INVENTION

Therefore, it is an object of the present invention to provide a lens edger having an apparatus for measuring lens curvature, which has a simple mechanical structure, and can be produced with a low cost.

It is other object of the present invention to provide a lens edger having an apparatus for measuring lens curvature, which has a good durability, less possibility of mechanical failures, and can be easily assembled and disassembled.

It is still another object of the present invention to provide a lens edger which is capable of measuring the lens curvature in a precise and simple mechanism.

To accomplish these objects, the present invention provides a lens edger including a carriage which rotatably fixes a pair of lens fixing shafts and moves the position of the lens fixing shafts clamping a lens to be processed; a lens rotation motor for rotating the lens fixing shafts; a carriage driving means for moving the carriage; and an apparatus for measuring a curvature of the lens. The apparatus for measuring lens curvature includes a curvature tracer which contacts with a side of the lens and detects a curvature of the lens by moving horizontally according to the curvature of the lens during a rotation of the lens; a curvature tracer rotator which rotates the curvature tracer to a position for measuring the lens curvature, and to which one end of the curvature tracer is inserted in a manner of allowing sliding movement of the curvature tracer in a horizontal direction; and a slider base which guides the movement of the curvature tracer in the horizontal direction, and provides a restoring force to the curvature tracer so that the lens and the curvature tracer can be maintained in a contacted state.

DETAILED DESCRIPTION OF THE INVENTION

Figure 1:
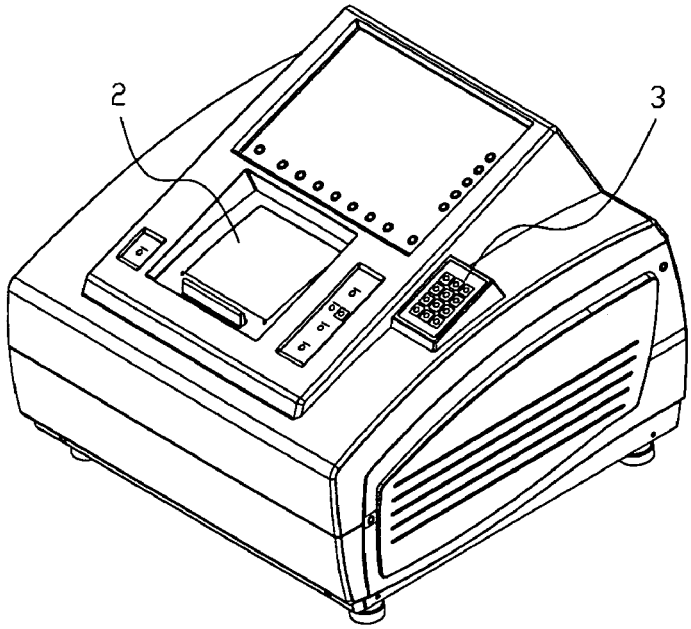
FIG. 1 is a perspective view for illustrating a conventional patternless lens edger.
Figure 2:
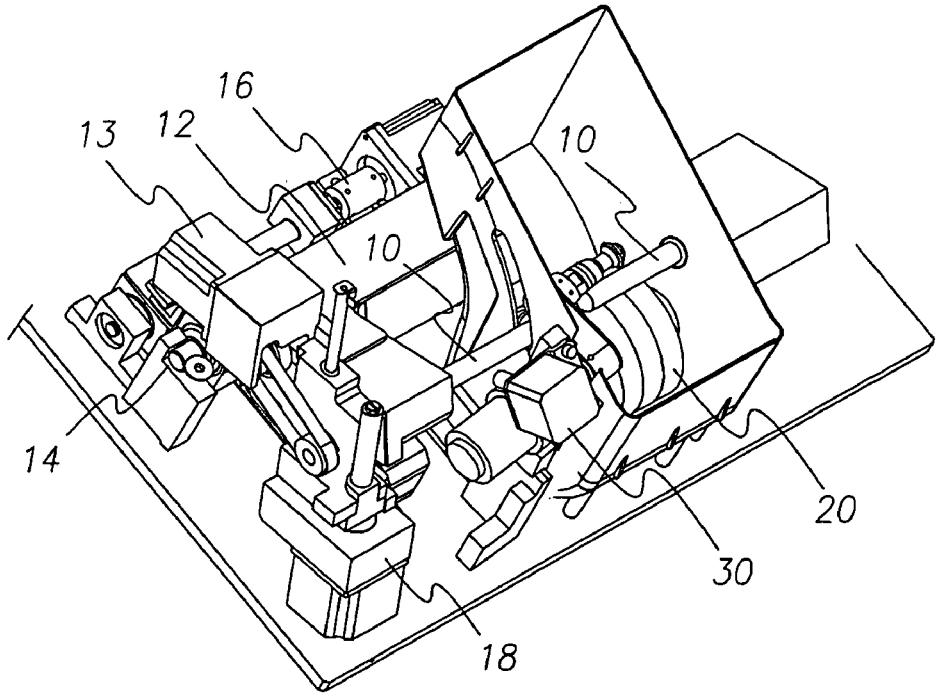
FIG. 2 is a perspective view of the internal structures of a conventional patternless lens edger for illustrating the operation of the lens edger.

A more complete appreciation of the invention and many of the attendant advantages thereof, will be better appreciated by reference to the following detailed description and attached drawings. In the attached drawings, similar or same reference numerals are given for elements having same or similar function.

Figure 3:
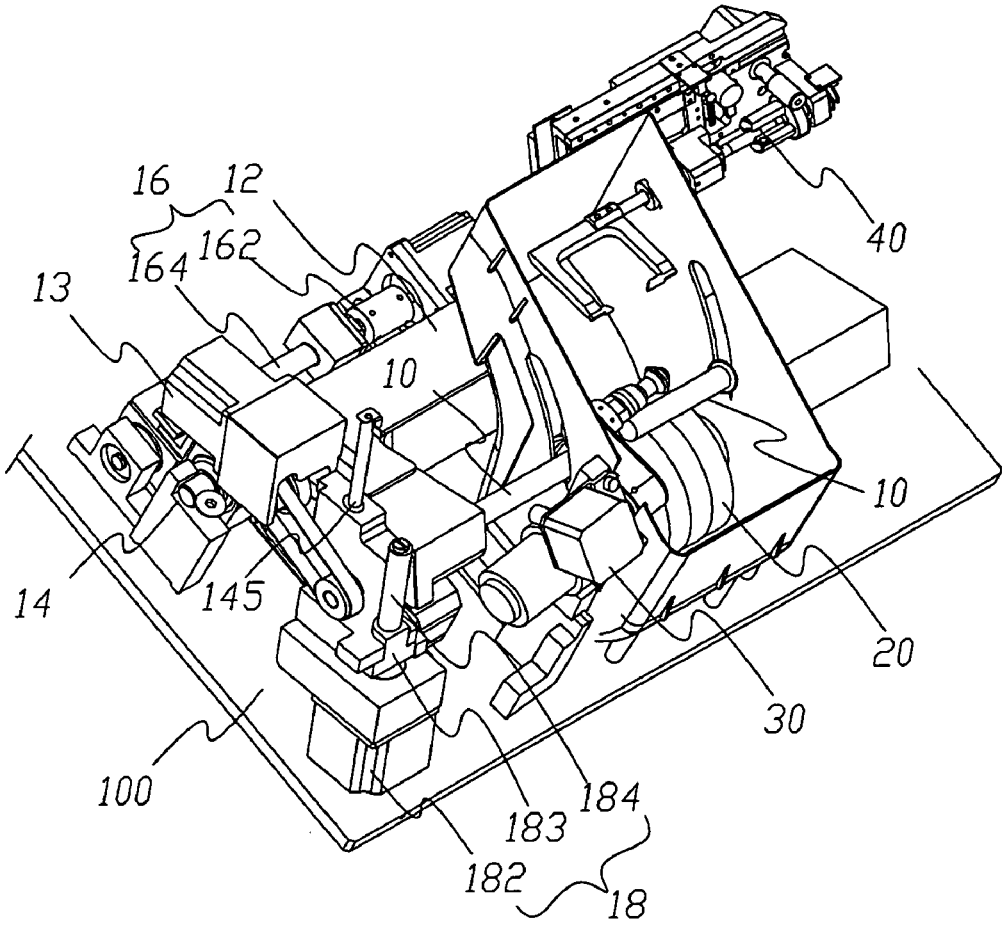
FIG. 3 is a perspective view of the internal structures of a patternless lens edger according to an embodiment of the present invention.
Figure 4:
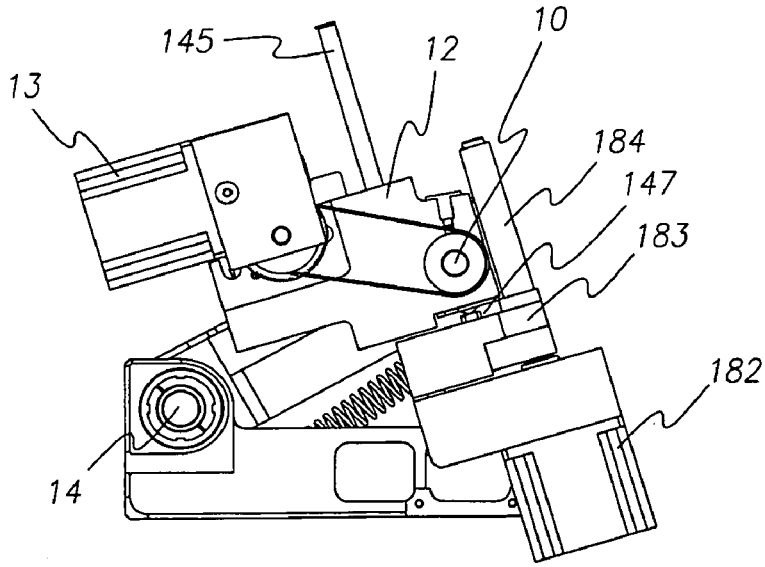
FIG. 4 is a side view of the internal structures of a patternless lens edger according to an embodiment of the present invention.

FIGS. 3 and 4 are a perspective view and a side view of the internal structures of the patternless lens edger according to an embodiment of the present invention. As shown in FIGS. 3 and 4, the lens edger according to an embodiment the present invention includes a pair of lens fixing shafts 10, a carriage 12, a carriage driving means which consists of a horizontal driving means 16 and a vertical driving means 18, a lens rotation motor 13, and an apparatus for measuring lens curvature 40. If necessary, the lens edger further include a groove forming member 30 and/or a grinding wheel 20. Except the apparatus for measuring lens curvature 40, other elements are previously explained. For example, the carriage 12 rotatably fixes the lens fixing shafts 10 and moves the position of the lens fixing shafts 10 clamping a lens to be processed, and one end of the carriage 12 is connected with the carriage movement axis 14. The carriage 12 rotates with the lens fixing shafts 10 in the rotational direction of the carriage movement axis 14, and slidably moves with the lens fixing shafts 10 in the longitudinal (i.e., axis) direction of the carriage movement axis 14. In operation, a lens is clamped between the lens fixing shafts 10. Then, the lens rotation motor 13 is operated to rotate the lens fixing shafts 10 so that the part of the lens to be grinded is directed to the grinding wheel 20. After directing the parts of the lens to be grinded to the grinding wheel 20, the horizontal movement means 16 and the vertical movement means 18 are operated so that the carriage 12 moves horizontally and vertically, and the lens clamped by the lens fixing shafts 10 contacts with the grinding wheel 20. Then, the grinding wheel 20 is rotated in a high speed to grind the lens to a desired shape.

The horizontal movement means 16 moves the carriage 12 horizontally, namely, in the longitudinal direction of the carriage movement axis 14, and may include a horizontal movement motor 162 mounted on a base plate 100 and a horizontal movement screw 164 which is rotated by the horizontal movement motor 162. The horizontal movement screw 164 is connected to one side of the carriage 12 by a screwed connection. Due to the screwed connection between the carriage 12 and the horizontal movement screw 164, the carriage 12 moves horizontally as the horizontal movement screw 164 rotates. The vertical movement means 18 moves the carriage 12 up or downwardly, namely, in the rotational direction of the carriage movement axis 14, and may include a vertical movement motor 182 mounted on a base plate 100 and a vertical movement screw 184 which is rotated by the vertical movement motor 182. The vertical movement screw 184 is connected to a position control block 183 by a screwed connection. The position control block 183 supports the carriage 12, and a direction guide 145 is formed on the position control block 183 for guiding the movement of the carriage 12 with respect to the position control block 183. Due to the screwed connection between the position control block 183 and the vertical movement screw 184, and also due to the direction guide 145 restricting the moving direction of the carriage 12 with respect to the position control block 183, the position control block 183 moves vertically when the vertical movement screw 184 rotates by the operation of the vertical movement motor 182. Therefore, the carriage 12, which is supported by the position control block 183, moves upwardly or downwardly, and more specifically, rotates around the carriage movement axis 14.

When the carriage 12 moves upwardly, and is located at the upper position, the lens is clamped between the lens fixing shafts 10. Then the carriage 12 moves downwardly until the lens clamped in the carriage 12 contacts with the grinding wheel 20. At this time, the lens is supported by the grinding wheel 20, and therefore the lens and the carriage 12 do not further move downwardly. Thereafter, the position control block 183 connected with the vertical movement screw 184 further moves downwardly by a distance (hereinafter, "gap distance") which is equal to the desired grinding thickness of the lens. Accordingly, the carriage 12 and the position control block 183 are disengaged by the gap distance. Then, the grinding wheel 20 rotates to grind the lens, and the carriage 12 moves downwardly by the gravitational force as the lens is grinded. When the downwardly moving carriage 12 operates a contact switch 147 mounted on the position control block 183, the rotation of the grinding wheel 20 stops, and lens grinding is completed.

Figure 5:
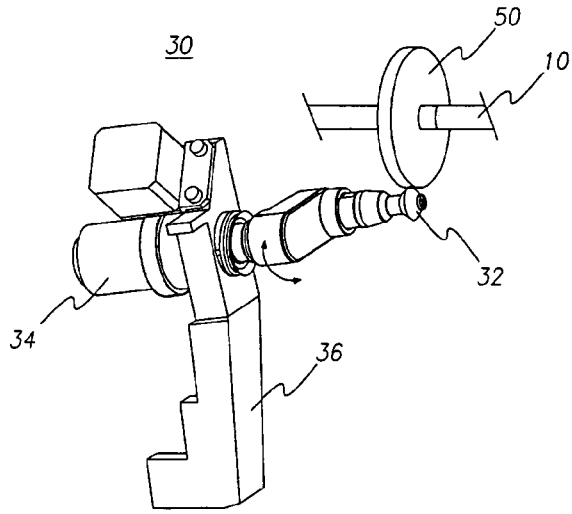
FIG. 5 is a perspective view of a groove forming member which can be used in a lens edger according to an embodiment of the present invention.

After processing the overall shape of the lens by the above-mentioned steps, the processed lens moves to the position for measuring the curvature of the lens. The lens curvature is measured with the apparatus for measuring lens curvature 40. After measuring the lens curvature, the processed lens moves so that the edge side of the lens contacts with the groove forming member 30, and the grooving, chamfering or bevel forming operation is carried out while moving the carriage 12 horizontally according to the measured lens curvature. FIG. 5 is a perspective view of the groove forming member 30 which can be used in the lens edger according to an embodiment of the present invention. As shown in FIG. 5, the groove forming member 30 includes a sharp wheel 32, and a wheel rotation motor 34 mounted on a main body 36. The sharp wheel 32 is connected with the wheel rotation motor 34 by power transmission means, such as gear, belt and so on. Therefore, the sharp wheel 32 rotates by the wheel rotation motor 34, and forms a groove or a bevel at the edge side of the lens 50 or chamfers the edge side of the lens 50.

Figure 6:
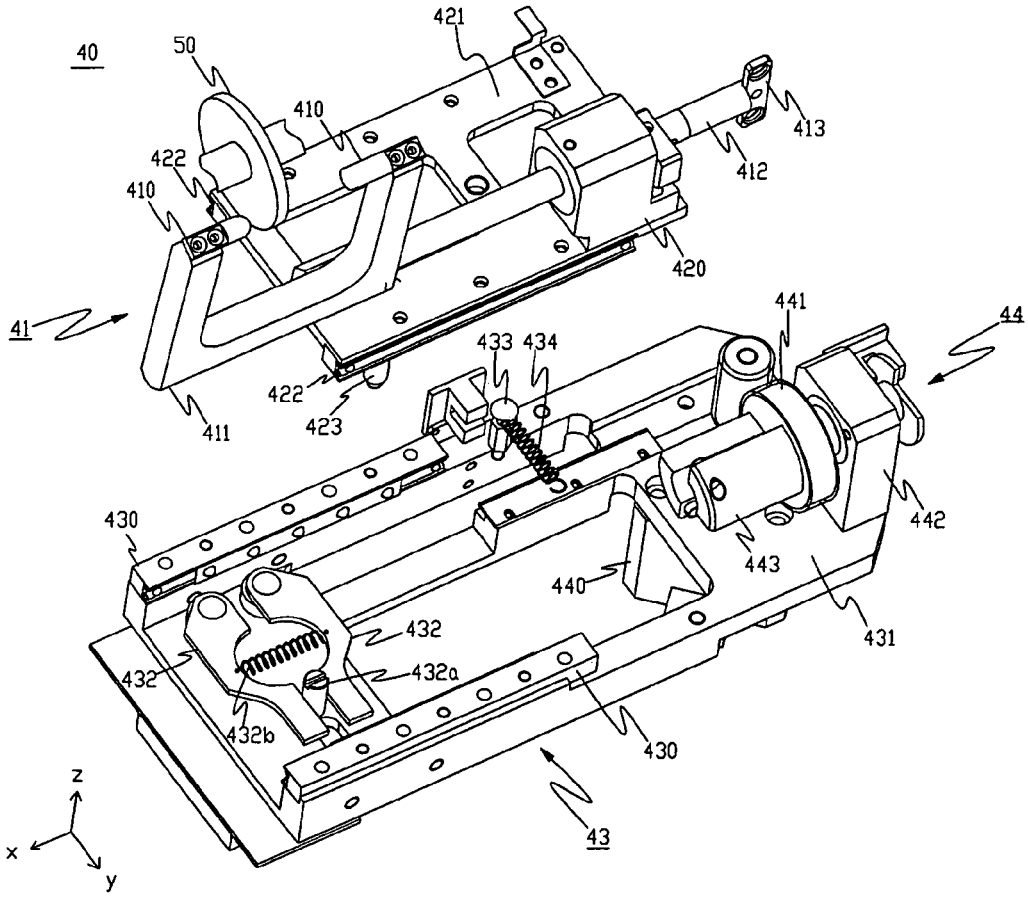
FIG. 6 is a partially exploded perspective view of an apparatus for measuring lens curvature used in a lens edger according to an embodiment of the present invention.

FIG. 6 is a partially exploded perspective view of the apparatus for measuring lens curvature 40 used in the lens edger according to an embodiment of the present invention. As shown in FIG. 6, the apparatus 40 includes a curvature tracer 41, a curvature tracer rotator 44, and a slider base 43. The curvature tracer 41 contacts with a side of the lens 50, and detects the curvature of the contacted side of the lens 50 by moving horizontally (i.e., x-direction) according to the curvature of the lens 50 during a rotation of the lens 50. The curvature tracer rotator 44 rotates the curvature tracer 41 to the position for measuring lens curvature. One end of the curvature tracer 41 is inserted to the curvature tracer rotator 44 in a manner of allowing sliding movement of the curvature tracer 41 in the horizontal direction. The slider base 43 guides the movement of the curvature tracer 41 in the horizontal direction, and provides a restoring force to the curvature tracer 41 so that the lens 50 and the curvature tracer 41 can be maintained in a contacted state.

Hereinafter, the apparatus for measuring lens curvature 40 will be described in more detail. The curvature tracer rotator 44 includes a slot-formed protrusion 443 and a tracer rotation motor 440. The rotate slot plate 413 formed at the end of the curvature tracer 41 is inserted to the slot of the protrusion 443 in a manner that the rotate slot plate 413 can slidably move in the horizontal direction (i.e., x-direction).

The tracer rotation motor 440 rotates the slot-formed protrusion 443 by power transmission means, such as a gear. For example, the curvature tracer rotator 44 may include a worm gear 441 for transmitting the power of the tracer rotation motor 440 to the slot-formed protrusion 443, and a bearing house 442 for supporting the worm gear 441. The curvature tracer 41 includes a pair of detection tips 410, a tip support 411, a tracer axis 412, and the rotate slot plate 413. The detection tips 410 are formed to face with each other so that each detection tip 410 contacts with each side of the lens 50 to detect the curvature of the contacted side. The tip support 411 is provided for supporting the detection tips 410. The tracer axis 412 is connected to the tip support 411, and is provided to rotate the detection tips 410 and the tip support 411. The rotate slot plate 413 is connected to the end of the tracer axis 412, and is inserted to the slot of the protrusions 443. In summary, the rotate slot plate 413 rotates as the tracer rotation motor 440 rotates, and the curvature tracer 41 and the curvature tracer rotator 44 are slidably engaged by means of the rotate slot plate 413. The curvature tracer 41 is mounted on a slide plate 421, and the slide plate 421 also moves horizontally (x-direction in FIG. 6) with the curvature tracer 41. On the slide plate 421, a shaft holder 420 is provided for rotatably supporting the tracer axis 412. Underneath the slide plate 421, the first stopper 423 of a protrusion shape is provided. At the lateral parts of the slide plate 421, which are extended to the x-direction, the first sliding guide, for example, a pair of the first sliding guides 422 is provided.

The slider base 43 includes a base frame 431 and the second sliding guide, for example, a pair of the second sliding guides 430. The second sliding guides 430 are formed on the upper and lower parts (in y-direction) of the base frame 431 to engage with the first sliding guides 422 of the slide plate 421, and guides the horizontal movement (in x-direction) of the slide plate 421 and the curvature tracer 41. On the base frame 431, a pair of levers 432 is pivotally connected to the base frame 431 at their one ends in a manner that the levers 432 face with each other. The levers 432 are connected with an elastic material 432*b* such as a spring, and thereby an attraction force is provided between the levers 432. The other ends of the levers 432 are supported by the second stopper 432*a*, which is formed on the base frame 431 and positioned between the levers 432. The second stopper 432*a* prevents the levers 432 from being contacted with each other by the attraction force of the elastic material 432*b* and from being inclined to one side.

The first stopper 423 of a protrusion shape, which is formed underneath the slide plate 421, is inserted between the other ends of the levers 432. Therefore, when the lens 50 pushes the curvature tracer 41 and the slide plate 421 to the left or right direction in x-direction, the first stopper 423 pushes the left or right lever 432, and the left or right lever 432 pivotally rotates to broaden the gap therebetween. Then, an attraction force of the elastic material 432*b* is provided to the pushed left or right lever 432. In other words, the elastic material 432*b* provides the restoring force to the opposite direction of the movement of the curvature tracer 41, and therefore the detection tip 410 of the curvature tracer 41 and the lens 50 are maintained in a securely contacted state. While maintaining the contacted state between the detection tip 410 and the lens 50, the lens 50 rotates, and the location of the curvature tracer 41 is measured with an encoder (not shown) to obtain the curvature of the lens 50.

Optionally, a tension spring 434 can be provided on the slider base 43 for preventing the unintentional rotation or shaking of the curvature tracer 41. For example, one end of the tension spring 434 is connected to a fixing protrusion 433 formed on the base frame 431, and the other end of the tension spring 434 is connected to the curvature tracer 41 through a hole formed on the slide plate 421. Then, the tension spring 434 pulls the curvature tracer 41 in a specified rotational direction. If the thickness of the rotate slot plate 413 and the width of the slot of the protrusion 443 differ from each other, and thereby the rotate slot plate 413 does not accurately fit to the slot of the protrusion 443, there is possibility of the unintentional rotation or shaking of the curvature tracer 41. The tension spring 434 prevents such unintentional rotation or shaking.

In operation, the tracer rotation motor 440 is operated to rotate the slot-formed protrusion 443 through the worm gear 441. The rotate slot plate 413 of the curvature tracer 41, which is inserted in the slot of the protrusions 443, rotates with the slot-formed protrusion 443, and thereby the curvature tracer 41 rotates to the position for measuring the lens curvature. After moving the curvature tracer 41 to the position for measuring the lens curvature, the carriage 12 moves so that the edge of one side of the lens 50 adheres to the detection tip 410. FIG. 6 shows that the left side of the lens 50 adheres to the left detection tips 410. In this case, the lens 50 pushes the curvature tracer 41 to the direction of the adhered detection tips 410 (i.e., left direction in the x-direction) by a predetermined distance. Then, the first stopper 423, which moves with the curvature tracer 41, pushes the left lever 432 to the left direction so that the gap between two levers 432 increases. As the left lever 432 moves to the left direction, the attraction force is provided to the left lever 432 by the elastic material 432*b*. In other words, the restoring force to the right direction is produced for the left lever 432, and the contact of the left detection tips 410 and the left side of the lens 50 can be securely maintained. Thereafter, the lens 50 rotates in a manner that the circumferential edge of the lens 50 adheres to the detection tip 410. This step can be carried out by moving carriage 12 according to the overall shape of lens 50 and rotating the lens fixing shafts 10. During the rotation, the curvature tracer 41 and the slide plate 421 moves in the horizontal direction (x-direction) according to the edge curvature of the left side of the lens 50, and the positions of the curvature tracer 41 and/or the slide plate 421 are measured with an encoder. The curvature of the left side of the lens 50 can be obtained from the measured positions of the curvature tracer 41 and/or the slide plate 421. After obtaining the left curvature of the lens 50, the lens 50 moves to the right direction so that the right side of the lens 50 pushes the right detection tips 410 by a predetermined distance. Thereafter, in the previously mentioned manner, the lens 50 rotates to obtain the right curvature of the lens 50. After measuring the lens curvatures, the lens 50 moves to the groove forming member 30 for grooving operation, chamfering operation, or bevel forming operation. This step can be performed by moving the carriage 12. And the curvature tracer 41 moves to its initial position by the operation of the tracer rotation motor 440. In the present invention, the lens 50 and the detection tip 410 are securely adhered during the 360 degree rotation of the lens 50, even though the curvature of lens 50 varies at its circumferential edge. Therefore, the curvature measurement errors can be minimized in the present invention.

While the present invention has been described in detail with reference to the preferred embodiments, those skilled in the art will appreciate that various modifications and substitutions can be made thereto without departing from the spirit and scope of the present invention as set forth in the appended claims.

The invention claimed is:

1. A lens edger, comprising:

a carriage which rotatably fixes a pair of lens fixing shafts and moves the position of the lens fixing shafts clamping a lens to be processed;

a lens rotation motor for rotating the lens fixing shafts;

a carriage driving means for moving the carriage; and an apparatus for measuring a curvature of the lens, wherein the apparatus for measuring lens curvature includes a curvature tracer which contacts with a side of the lens and detects a curvature of the lens by moving horizontally according to the curvature of the lens during a rotation of the lens; a curvature tracer rotator which rotates the curvature tracer to a position for measuring the lens curvature, and to which one end of the curvature tracer is inserted in a manner of allowing sliding movement of the curvature tracer in a horizontal direction; and a slider base which guides the movement of the curvature tracer in the horizontal direction, and provides a restoring force to the curvature tracer so that the lens and the curvature tracer can be maintained in a contacted state.

2. The lens edger according to claim 1, wherein the curvature tracer rotator comprises a slot-formed protrusion; and a tracer rotation motor for rotating the slot-formed protrusion, and a rotate slot plate formed at the end of the curvature tracer is inserted to a slot of the slot-formed protrusion.

3. The lens edger according to claim 1, wherein the curvature tracer comprises a pair of detection tips which are formed to face with each other, each detection tip contacts with each side of the lens to detect the curvature of the contacted side; a tip support for supporting the detection tips; a tracer axis for rotating the detection tips and the tip support; and the a rotate slot plate connected to the end of the tracer axis, and is inserted to the curvature tracer rotator.

4. The lens edger according to claim 1, wherein the curvature tracer moves horizontally with a slide plate, a first sliding guide is provided at the slide plate, the slider base includes a base frame and a second sliding guide, and the second sliding guide is formed on the base frame to engage with the first sliding guide.

5. The lens edger according to claim 4, wherein a first stopper is provided underneath the slide plate, a pair of levers is pivotally connected on the base frame in a manner that the levers face with each other, the levers are connected with an elastic material, and the first stopper is inserted between the levers.

6. The lens edger according to claim 5, wherein the levers are supported by the second stopper, which is formed on the base frame and positioned between the levers.

7. The lens edger according to claim 1, further comprising a tension spring, one end of which is connected to the slider base, the other end of which is connected to the curvature tracer, for pulling the curvature tracer in a rotational direction.

* * * * *